US005144285A

United States Patent [19]

Gore

[11] Patent Number: 5,144,285

[45] Date of Patent: Sep. 1, 1992

[54] PULSED ULTRA SONIC SWIMMING POOL ALARM APPARATUS

[76] Inventor: Milton W. Gore, 16036 N. 47th Dr., Maricopa County, Glendale, Ariz. 85306

[21] Appl. No.: 619,473

[22] Filed: Nov. 29, 1990

[51] Int. Cl.[5] ..... G08B 13/18; G08B 21/00

[52] U.S. Cl. ..... 340/573; 340/531; 340/541; 340/572; 367/131; 367/137; 441/80

[58] Field of Search ..... 340/573, 572, 531, 541; 367/131, 137; 441/80

[56] References Cited

U.S. PATENT DOCUMENTS 3,500,373 3/1970 Minasy ..... 340/572
3,810,146 5/1974 Lieb ..... 340/541
5,033,033 7/1991 Schram ..... 367/137
5,049,859 9/1991 Arnell ..... 340/573

*Primary Examiner*—Glen R. Swann, III
*Attorney, Agent, or Firm*—H. Gordon Shields

[57] ABSTRACT

Pulsed ultrasonic apparatus for monitoring a swimming pool includes a transmitter housing securable to a child and provides a swept frequency pulsed output from a transducer within the housing when an electrical circuit is completed by having a pair of tabs on the outside of the housing immersed in water. The output from the transducer is detected by a receiving hydrophone and the hydrophone is connected to receiver circuitry which provides an appropriate alarm signal.

7 Claims, 2 Drawing Sheets

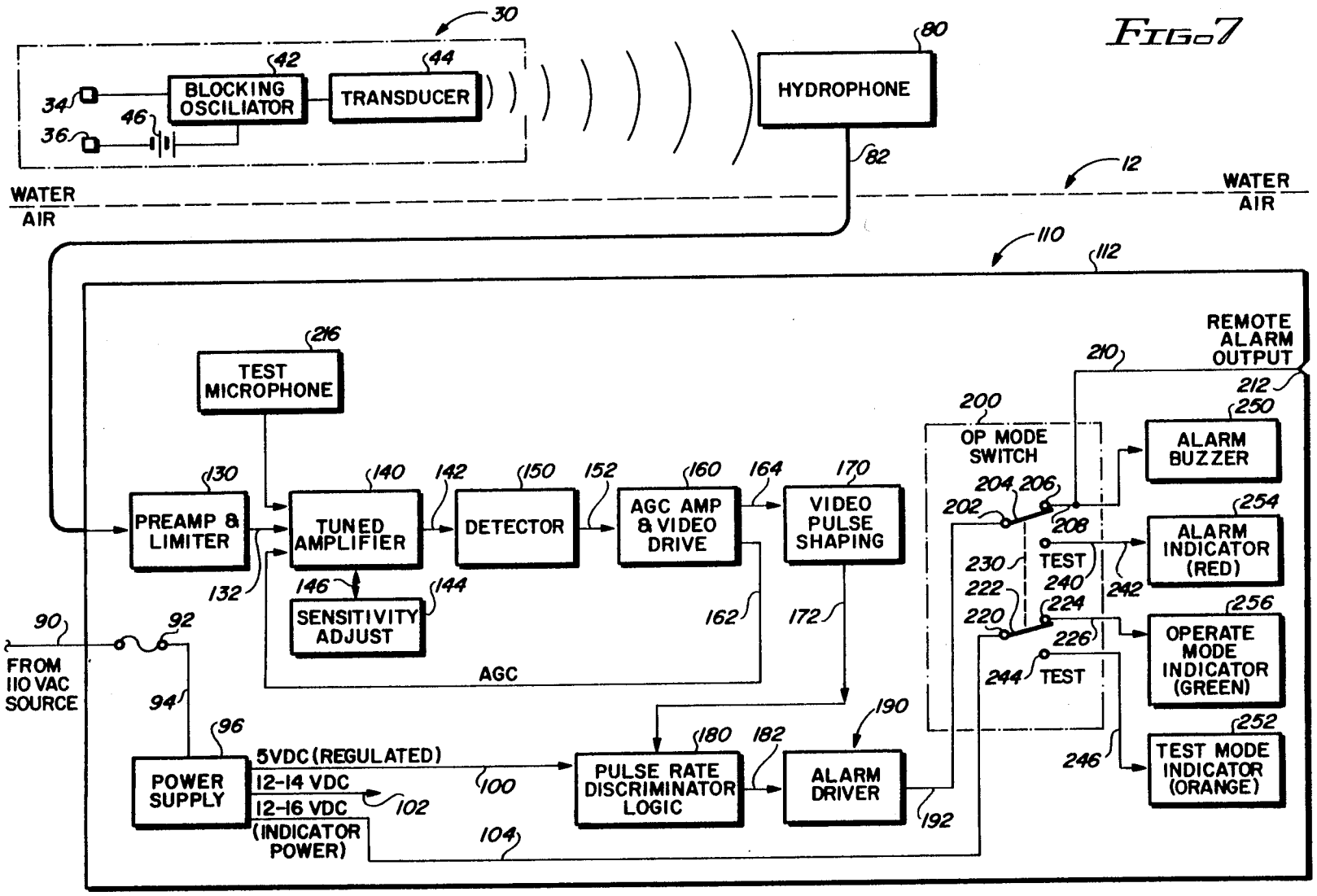
Fig 7
WATER
AIR
12
110
112
REMOTE ALARM OUTPUT
212
250
ALARM BUZZER
254
ALARM INDICATOR (RED)
256
OPERATE MODE INDICATOR (GREEN)
252
TEST MODE INDICATOR (ORANGE)
210
242
246
208
TEST
240
224
226
TEST
206
204
202
230
222
220
244
200
OP MODE SWITCH
80
HYDROPHONE
82
192
190
170
VIDEO PULSE SHAPING
172
ALARM DRIVER
164
182
160
AGC AMP & VIDEO DRIVE
162
180
PULSE RATE DISCRIMINATOR LOGIC
152
150
DETECTOR
30
44
TRANSDUCER
142
144
AGC
100
104
140
TUNED AMPLIFIER
146
SENSITIVITY ADJUST
102
42
BLOCKING OSCILLATOR
216
TEST MICROPHONE
130
PREAMP & LIMITER
132
5VDC (REGULATED)
12-14 VDC
12-16 VDC
(INDICATOR POWER)
96
POWER SUPPLY
92
94
46
34
36
90
FROM 110 VAC SOURCE
WATER
AIR

PULSED ULTRA SONIC SWIMMING POOL ALARM APPARATUS

BACKGROUND OF THE INVENTION

1. Field of the Invention

This invention relates swimming pool alarms and, more particularly, a swimming pool alarm system using several elements, including an ultrasonic transmitter secured to a child, a hydrophone disposed in the swimming pool and connected to appropriate receiver circuitry for providing an audible alarm in response to the operating transmitter being immersed in the pool.

2. Description of the Prior Art

There are different types of swimming pool alarms in contemporary use. One type of swimming pool alarm includes some type of electronic monitoring or sensing of an area about a swimming pool. When a child intrudes into the guarded area, some type of alarm sounds. Such systems are generally quite expensive to both install and to maintain.

Another type of swimming pool alarm system in the prior art includes a covering over a swimming pool and a sensor connected to the cover. When the cover is disturbed, as by a child falling onto it, etc., and audible alarm sounds.

Still another type of alarm apparatus used for a swimming pool is an alarm on a gate. When the gate is opened, a buzzer, or the like, sounds to alert people of the fact that the alarmed gate has been opened.

Another type of swimming pool alarm system utilized wave action to sound an alarm. Wave motion resulting from a body, large or small, falling into the pool is sensed and an alarm sounds.

All of the various types of alarm systems have a single purpose, and that is to alert adults that a child has fallen, or may fall, into a swimming pool. The apparatus of the present invention utilizes current technology to provide a transmitter securable to a child's body or clothing and that is activated when it is immersed in water. The transmission is received and an audible alarm sounds.

SUMMARY OF THE INVENTION

The invention described and claimed herein comprises a miniature, pulsed ultrasonic transducer/transmitter securable to a child. The transmitter is activated when it is immersed in water. When the transmitter is activated, its output is a continuous stream of ultransonic pulses that sweep over a predetermined frequency range and are detected or received by a hydrophone disposed in the swimming pool. The hydrophone is in turn connected to an exterior sound generating apparatus that provides an audible alarm when the ultrasonic transducer, the transmitter on the child, is activated by the water.

Among the objects of the present invention are the following:

To provide new and useful pool alarm systems;

To provide new and useful swimming pool alarm system including a pulsed, ultrasonic transmitter and a hydrophone receiver;

To provide a new and useful ultrasonic transmitter that is activated when immered in water;

To provide a sweep frequency transducer for an ultransonic transmitter;

To provide new and useful alarm system for a swimming pool including a hydrophone disposed in the swimming pool and a transmitter securable to a child.

BRIEF DESCRIPTION OF THE DRAWING

FIG. 7 is a block diagram illustrating the operation of the apparatus of the present invention.

DESCRIPTION OF THE PREFERRED EMBODIMENT

Figure 1:
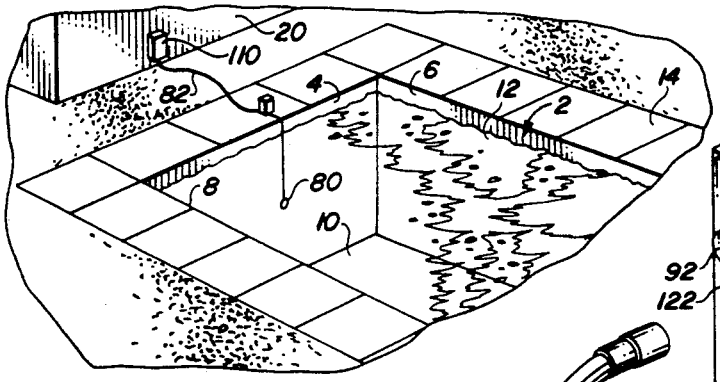
FIG. 1 is a perspective view of the use environment of the apparatus of the present invention.

FIG. 1 is a perspective view showing a swimming pool 2 which is the use environment of the apparatus of the present invention. The swimming pool 2 includes, as shown in FIG. 1, an end wall 4 and a pair of side walls 6 and 8. There is also shown a swimming pool bottom 10. The pool 2 is filled with water 12. There is a deck or periphery 14 about the pool. A building 20, which may be a house, is spaced apart form the pool 2. On the wall of the building 20 is a receiver 110. The receiver 110 is connected to a hydrophone 80 by a cable or appropriate electrical conductor 82.

The hydrophone 80 is disposed in the pool 2 and in the water 12 on the wall 4. The hydrophone 80 is connected to the receiver 110 by the cable 82.

Figure 2:
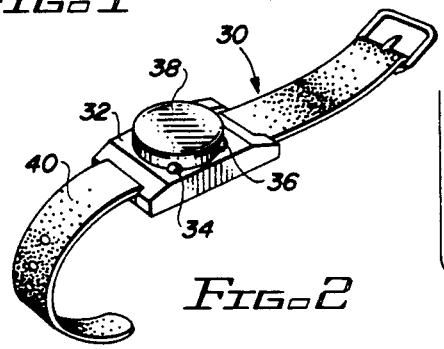
FIG. 2 is a perspective view of transmitter apparatus which is a portion of the apparatus of the present invention.

FIG. 2 is a perspective view of a transmitter 30, which is in the form of a wrist element, or an element to be secured to a user's wrist. A typical user would be a child who would be in danger if the child fell into the water 12 or the pool 2.

The transmitter 30 includes a base housing 32 secured to a strap 40. The strap 40 would be secured to the users wrist. The transmitter 30, by means of the strap 40, could also be secured to a users ankle, if desired. In some small children, it may be advantageous to have the transmitter 30 secured about an ankle, rather than a wrist.

Secured to the base housing 32 is a conductive tab 34 and a conductive tab 36. The conductive tabs 34 and 36 are spaced apart from each other. They are in turn secured to elements within a transducer housing 38.

When the tabs 34 and 36 are immersed in water, a circuit is completed to elements within the transducer housing 38, and appropriate ultransonic signals are transmitted through the water. The transmitter 30 provides ultrasonic vibration in bursts of pulses. The pulses are received and decoded as discussed below, and an appropriate alarm signal is generated.

With respect to the apparatus of the present invention, if a child were to fall into the water 12 of the pool 2, with the transmitter 30 secured to the child, the water 12 would act as a conductor between the tabs 34 and 36 and a transducer within the housing 38 would be activated and would transmit pulses which would be received by the hydrophone 80 and relayed by the cable 82 to the receiver 110. In turn, circuitry as illustrated in FIG. 7 would ultimately provide an alarm to alert people that a child wearing the transmitter 30 has fallen into the water 12 of the pool 2.

Figure 3:
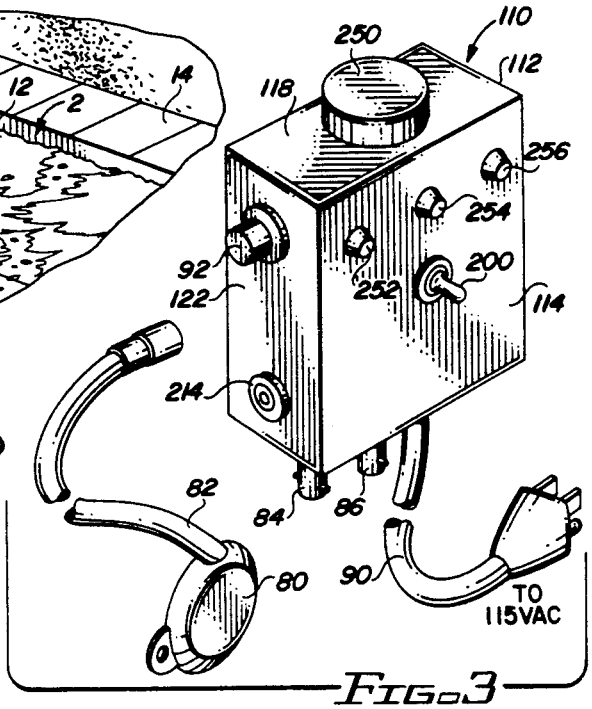
FIG. 3 is a perspective view of part of the receiver apparatus which is also a portion of the apparatus of the present invention.
Figure 4:
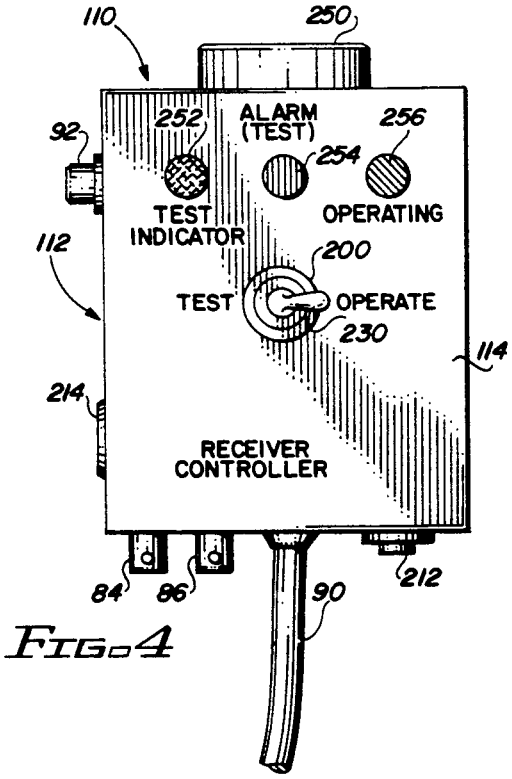
FIG. 4 is a front view of a portion of the apparatus of FIG. 3.
Figure 5:
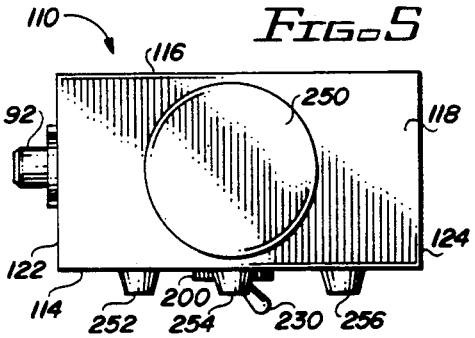
FIG. 5 is a top view of the apparatus of FIG. 4.
Figure 6:
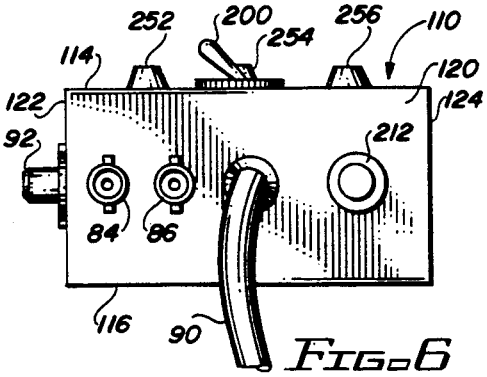
FIG. 6 is a bottom view of the apparatus of FIG. 4.

FIG. 3 is a perspective of the receiver 110, and particularly of the housing 112 of the receiver 110 and its associated components. FIG. 4 is a front view of the housing 112 of the receiver 110 illustrating various elements or components. FIG. 5 is a top view of the receiver 110 and its housing 112, and FIG. 6 is a bottom view of the housing 112 of the receiver 110. FIG. 7 is a view illustrating the circuitry involved in the receiver 110 and a schematic representation of the transmitter 30 and the operation of the transmitter 30 and the hydrophone 80 and the receiver 110. For the following discussion, reference will primarily be made to FIGS. 3, 4, 5, 6, and 7.

The receiver 110 includes a housing 112 which is preferably a generally rectangular box. The housing 112 includes a front panel 114, a back panel 116, a top panel 118, a bottom panel 120, and a pair of side panels 122 and 124.

Within the housing 112 is the circuitry which receives pulse from the transmitter 30 through the hydrophone 80. The hydrophone 80 is connected to the receiver 110 through the cable 82. The cable 82 is connected to an appropriate connector 84 on the bottom panel 120 of the housing 112.

Power for the circuitry in the receiver 110 is provided by connection to 110 volt house current by an input power cable and plug 90. Input power is routed through a fuse 92 and a conductor 94 to a power supply 96. The power supply 96 provides three different voltages, including a five volt DC regulated voltage on a conductor 100, a 12 to 14 volt DC power supply on a conductor 102, and a 12 to 16 volt DC power on a conductor 104. This will be discussed in more detail below.

The transmitter 30, when the tabs 34 and 36 are immersed in water, produces a continuous stream of periodic bursts of electrical signals at ultrasonic frequencies. The ultrasonic electrical energy from a blocking oscillator 42 excites a piezoelectric transducer 44 which transmits the resulting acoustic vibrations into the pool water 12.

The pulses or bursts of ultransonic energy are separated in time in order to provide sufficient time for the echoes to diminish to a noninterference level in the water 12 prior to the reception of the next pulse burst.

The transmitter 30 includes the blocking oscillator 42 connected to the transducer 44. The blocking oscillator 42 provides a frequency range for the transducer 44 to insure that a predetermined frequency range is swept. The pulses from the transducer 44 accordingly are dispersed to provide a signal that will be received by the hydrophone receiver 80 regardless of where the transmitter 301 child is located in the pool 2. The walls 4 . . . 8, the bottom 10, etc., of the pool and the orientation of the child as it falls into the pool 2 will not block the output pulses from the transmitter 30 due to the swept frequency of the output pulses. That is, the use of a swept frequency output signal prevents dead spots or nulls or zones of silence, due to the configuration of the swimming pool or the orientation of a child as the child falls into the water, from blocking the output signal from being received by the receiver 80. This insures that some part of the output signal will be received even though other parts may be blocked. The sweeping of the frequencies causes the zones of silence to move back and forth to prevent fixed dead spots in the pool.

The oscillator 42 is connected to the tab 34. A battery 46 is secured to the tab 36 and to the oscillator 42 to provide power for the transmitter 30. When the tabs 34 and 36 are immersed in water, the circuit between the battery 4 and the oscillator 42 is complete, and swept frequency pulses from the transducer are transmitted in the water 12 of the pool 2.

The receiving hydrophone 80, which may be permanently installed on the wall 4 of the pool 2, includes a piezoelectric transducer that produces an electrical signal responsive to the acoustic vibrations in the pool. The electrical response from the hydrophone 80 is transmitted through the cable 82, which may be a coaxial cable, to a preamplifier and limiter 130 within the housing 112 of the receiver 110. In the circuitry involved in the receiver 110, the signals are appropriately processed, detected, and the pulses received by the hydrophone 80 are appropriately evaluated. If the received pulses are identified as signals from the transmitter 30, an appropriate alarm is sounded.

The preamplifier and limiter 130 provides an appropriate gain for the signal received from the hydrophone 80. The pre-amplifier and limiter 130 passes on signals to a tuned amplifier 140 on a conductor 132. Sensitivity of the tuned amplifier 140 is varied by an adjuster 144. The sensitivity adjust 144 is connected to the amplifier 140 through coupling 146. The purpose of the sensitivity adjustment is to accommodate the sensitivity requirements of individual pools.

Power for the preamplifier and limiter is on conductor 102 from the power supply 96.

From the tuned amplifier 140, an output signal is transmitted on a conductor 142 to a detector 150. Within the detector 150, appropriate filtering of the signal takes place to prevent noise spikes from producing an unwanted response and to reduce the amplitude modulation of the incoming signal.

From the detector 150, an output signal on a conductor 152 is transmitted to an automatic gain control amplifier and video drive circuitry 160. The circuitry 160 serves as a threshold detector and amplifier for that portion of the detected signal from the hydrophone 80 which exceeds a certain predetermined minimum required to turn on the electrical elements, or an electrical element, such as an appropriate transistor, in the circuitry 160.

Automatic gain control of the detected amplifier signals is accomplished by providing a closed loop in which the output from the circuitry 160 is transmitted on a conductor 162 back to the tuned amplifier 140. An output signal from the circuitry 160 is also transmitted on a conductor 164 to a video pulse shaping circuitry 170. The video pulse shaping circuitry 170 further shapes and conditions the output pulses to provide a desired signal output. The output signal from the video pulse shaping circuitry 170 is transmitted on a conductor 172 to a pulse rate discriminator logic 180.

The pulse rate discriminator logic 180 receives regulated five volt DC power on the conductor 100 from the power supply 96. Its input signal is on the conductor 172 from the video pulse shaping circuit 170.

The pulse rate discriminator logic circuitry 180 includes logic circuitry to determine whether the stream of pulses from the video pulse shaping circuit 170 meet predetermined criteria. The predetermined criteria are that the incoming pulses are in fact the result of the ultrasonic pulses from the transmitter 30, indicating that the transmitter 30 has been immersed in water and is transmitting a signal, and that output signal is the signal received by the hydrophone 80.

The pulse rate discriminator logic 180 includes a monostable multivibrator, or a one shot (OS) multivibrator, having a minimum "on" period of preestablished or predetermined time in accordance with the circuitry criteria. At the beginning of an interrogation cycle in the pulse rate discriminator logic circuitry 180, the first arriving pulse actuates the one shot (OS) multivibrator, and the "on" time of the multivibrator defines the period or cycle time of the pulse rate query. At the beginning of the query cycle, the input pulses are directed to a decade counter, the output of the counter moves to the "on" state at the end of ninth received pulse and the counter remains in that "on" state for one pulse period and then return to the "off" state.

The falling edge of the counter output sets a flip-flop (FF), the output of which moves to the "on" state and remains in that state until reset. At the end of the query period the query OS is combined with the state of the previously mentioned FF output. If the FF is in the "on" state, indicating that at least ten pulses have been counted during the query period, a pulse is sent to an alarm indicating "retriggerable monostable multivibrator" or ROS at the end of the query period when the query one shot multivibrator output returns to the "off" state. The pulse sent to the "fail" ROS sets the ROS to the "on" state to indicate the detections of the presence of a transmitter. This "fail" ROS remains in the "on" state for a predetermined time period if no further fail indication pulses arrive within that time period.

At the end of the query period a pulse is sent to a reset ROS. This ROS generates a short pulse at this time to reset the FF to the "off" state and the counter to zero. At this time the input pulses are redirected from the counter input to the query OS to repeat the cycle. This period of the query OS is sufficient time for eleven pulses to arrive at the counter. This allows one pulse of eleven to be missed in the alarm decision.

The delay period of the retriggerable "fail" ROS can be any value greater than the query period. Each query cycle that indicates a detected alarm situation extends the period of distress by the normal 0.6 second delay of the alarm (fail) ROS. This results in a continuous alarm command as long as ten or more pulses are detected.

The normal delay period of this ROS could be extended to provide a delay of twice that of the query period. For this condition a single query period in which a count of ten is not reached would not turn off the alarm. Extensive testing indicates that this is not necessary. The fact that the alarm turns off for a fraction of a second does not detract from the alarm significance.

In summation, the alarm criteria for the pulse rate discriminator 180 is only that the pulse rate is ten or more pulses within a predetermined time period.

The output of the pulse rate descriminator 180 drives a transistor, the collector of which supplies a circuit ground as a drive mechanism for an alarm buzzer 250 or other indicator. Resistor and diodes can isolate the primary alarm buzzer 150 and remote alarms to prevent a failure in one alarm from affecting the operation of the others.

The signal evaluation process requires approximately 0.35 seconds to complete. When a match is found, the alarm will sound until the transmitter is removed from the pool. The nature of the alarm for the engineering prototype is a repeating series of 'beeps' having an on-off cycle of approximately 1.5 seconds. When the transmitter is removed approximately 80 feet, an additional receiving transducer or hydrophone may be introduced to provide better coverage of the pool volume. That additional hydrophone may be connected to a connector jack 86 on the bottom panel 120. The jack 86, is, of course, appropriately connected to the preamplifier and limiter 130 in parallel with the input from the hydrophone 80.

When the received pulses have been determined by the pulse rate discriminator logic 180 to be the appropriate pulses received from the hydrophone 80 from the transmitter 30, an alarm driver 190 receives an appropriate output signal from the pulse rate discriminator logic 180 on conductor 182.

From the alarm driver 190, an appropriate signal is sent on a conductor 192 to the alarm buzzer or audible alarm 250 through a switch 200. The switch 200 includes a pair of terminals 202 and 220, to which are connected armatures or moving elements 204 and 222, respectively. The armatures 204 and 222 are connected together by a coupling element or test actuator 230.

The switch 200 is preferably spring biased to connect the contact 202 and the armature 204 to a terminal 206, and the terminal 220 and armature 222 to a terminal 224.

Extending from the terminal 206 is a conductor 208. The conductor 208 extends to the alarm buzzer 250. A conductor 210 is also illustrated in FIG. 7 extending from the conductor 208 to a remote alarm output jack 212, on the bottom panel 120 of the housing 112, and which remote alarm may be within the building 20 or elsewhere, as desired.

The terminal 224 is connected by a conductor 226 to a mode indicator light, such as a green light 256.

The armature 204 is movable between the terminal 206 and a test terminal 240. The test terminal 240 is connected to an alarm indicator, which may be a red light 254, by a conductor 242. The armature 222 is movable between the terminal 224 and a terminal 244, which is also a test terminal. The test terminal 244 is connected to a test mode indicator, which may be an orange light 252, by a conductor 246.

The terminal 220 is connected to the power supply 96, and specifically to the 12 to 16 volt DC output from the power supply 96 by the conductor 104. Accordingly, when the switch 230 is moved to the test position, the armature 222 moves to connect the terminal 220 and the indicator power on conductor 104, to the orange test light 252 through the terminal 244 and the conductor 246. The illuminating of the orange test light indicates that power is provided by the power supply 96 at least on the conductor 104.

when the test switch 230 is moved to the test position, the armature 204 is moved away from the terminal 206 to the terminal 240. An output from the driver alarm 190 on conductor 192 then is transmitted on conductor 192 and from the terminal 202 and armature 204 to the terminal 240 and the conductor 242 to the alarm indicator red light 254. However, when the armature 204 moves away from the terminal 206 and moves to the terminal 240, no output is provided to the alarm buzzer 250 on the conductor 208 or to a remote alarm output 212 on the conductor 210.

Also for test purposes, a test microphone 216 is shown in FIG. 7 connected directly to the tuned amplifier 140. The test microphone 216 is connected to the receiver 110 through a jack 214 on the end panel 122 of the housing 112.

Only one hydrophone 80 is shown in FIG. 1. However, the number of hydrophones actually used will depend on the size of a particular pool and the shape of the pool. The hydrophone(s) will preferably be installed as a permanent installation. Accordingly, the conductor(s) 82 will not be merely disposed as shown in FIG. 1. Rather, the electrical wiring will be appropriately concealed, etc., as required and as practical.

For a second hydrophone, a second input jack 86 is shown in FIGS. 3 and 6. A second input cable, a duplicate of the cable 82, is not shown.

Not shown in FIG. 7 is a battery backup for the power supply to the preamplifier and limiter 130. It will be noted that the conductor 102 from the power supply 96 provides 12–14 volts dc for the preamplifier and limiter 130. For emergency purposes, a 12 volts battery could be used as an emergency backup. Such is well known and understood in the art.

While the apparatus of the present invention has been shown in the environment of a swimming pool, it is obvious that the elements of the invention could also be used to monitor a portion of a lake or other body of water. The number of hydrophones, etc., required would, of course, depend on the size of the body of water being monitored.

While the principles of the invention have been made clear in illustrative embodiments, there will be immediately obvious to those skilled in the art many modifications of structure, arrangement, proportions, the elements materials, and components used in the practice of the inventions, and otherwise, which are particularly adapted to specific environments and operative requirements without departing from those principles. The appended claims are intended to cover and embrace any and all such modifications, within the limits only of the true spirit and scope of the invention.

What I claim is:

1. Pulsed ultrasonic alarm apparatus for providing an alarm when a child has fallen into a body of water, such as a swimming pool, comprising, in combination:

means for providing a swept frequency output signal in the body of water in response to the child's falling into the body of water the sweeping of said frequency preventing fixed dead spots in the body of water;

receiver means in the body of water for detecting at least some part of the swept frequency output signal; and means for providing an alarm signal in response to the detected output signal.

2. The apparatus of claim 1 in which the means for providing the swept frequency output signal includes transducer means for providing output pulses at ultrasonic frequencies.

3. The apparatus of claim 2 in which the receiver means includes a hydrophone.

4. The apparatus of claim 1 in which the means for providing a swept frequency output signal includes housing means for electrical circuitry securable to a child.

5. The apparatus of claim 4 is which the means for providing a swept frequency output signal further includes a pair of tabs secured to the housing means and electrical circuitry disposed in the housing means, the tabs being connected to the electrical circuity in the housing means.

6. The apparatus of claim 5 in which the electrical circuitry includes a blocking oscillator for providing a plurality of frequencies and a transducer connected to the blocking oscillator for providing bursts of ultrasonic pulses in response to the blocking oscillator.

7. The apparatus of claim 6 in which the tabs comprise terminals which complete an electrical circuit to the blocking oscillator when immersed in water.

* * * * *